US009038840B2

(12) United States Patent
Umholtz

(10) Patent No.: US 9,038,840 B2
(45) Date of Patent: May 26, 2015

(54) MULTI-COMPARTMENTED SANDWICH STORAGE DEVICE

(71) Applicant: Kurt Umholtz, Mount Dora, FL (US)

(72) Inventor: Kurt Umholtz, Mount Dora, FL (US)

( * ) Notice: Subject to any disclaimer, the term of this patent is extended or adjusted under 35 U.S.C. 154(b) by 0 days.

(21) Appl. No.: 13/916,345

(22) Filed: Jun. 12, 2013

(65) Prior Publication Data

US 2014/0367302 A1 Dec. 18, 2014

(51) Int. Cl.

| | |
|---|---|
| ***B65D 1/24*** | (2006.01) |
| ***B65D 25/04*** | (2006.01) |
| ***B65D 81/32*** | (2006.01) |
| *B65D 6/00* | (2006.01) |

(52) U.S. Cl.

CPC ..... *B65D 81/32* (2013.01)

(58) Field of Classification Search

CPC ..... A47J 47/14; A45C 11/20; B65D 25/08
USPC ..... 220/4.27, 4.26, 5.4, 524, 529, 916, 502, 220/54; 206/541
See application file for complete search history.

(56) References Cited

U.S. PATENT DOCUMENTS

| | | | | |
|---|---|---|---|---|
| 2,510,211 | A * | 6/1950 | Cleary | 229/120.32 |
| 5,012,971 | A * | 5/1991 | Cozzi et al. | 229/120.07 |
| 5,062,539 | A * | 11/1991 | Chandler | 220/4.27 |
| 5,392,906 | A * | 2/1995 | Taniyama | 206/311 |
| 5,699,925 | A * | 12/1997 | Petruzzi | 220/4.27 |
| 2009/0050495 | A1* | 2/2009 | Marcus et al. | 206/217 |
| 2010/0237070 | A1* | 9/2010 | Coonce et al. | 220/203.29 |
| 2011/0121002 | A1* | 5/2011 | Stiller | 220/504 |
| 2011/0215023 | A1* | 9/2011 | Archie et al. | 206/541 |
| 2013/0161377 | A1* | 6/2013 | Nebeker et al. | 229/116.5 |

* cited by examiner

*Primary Examiner* — Mickey Yu
*Assistant Examiner* — Niki Eloshway
(74) *Attorney, Agent, or Firm* — Jason T. Daniel, Esq.; Daniel Law Offices, P.A.

(57) ABSTRACT

A multi-compartmented food storage device having a top hermetic storage compartment, a bottom hermetic storage compartment and a central hermetic storage compartment that is interposed there between. Each of the top and bottom compartments being hingedly secured to the central compartment along an upper and lower end.

10 Claims, 9 Drawing Sheets

MULTI-COMPARTMENTED SANDWICH STORAGE DEVICE

BACKGROUND

Field of the Invention

The present invention relates generally to food storage devices, and more particularly to multi-compartmented storage devices for storing the ingredients of a sandwich in separate compartments to prevent the moist ingredients from rendering the dry ingredients soggy.

Since the advent of sliced bread, sandwiches have been a staple food item for those unable to have a sit down, multi course meal, but rather must eat their meal "on the go". Sandwiches have become a practical food choice for families with children and they are arguably the most common food item in the traditional bad lunch that millions of children take to school every day of the school year.

In order to maximize the nutritional value and increase tastiness, incorporating water-rich accouterments such as lettuce and tomato to compliment the bread and protein ingredients of the sandwich has become the norm in sandwich making industry.

Anyone who has ever assembled a sandwich and then been distracted for an extended period of time before returning to their sandwich has experienced the unpleasant phenomena of the "soggy sandwich." To this end, sandwiches become soggy when the bread of the sandwich absorbs the juices and water from the accouterments and the once rigid and crisp bread is rendered soggy and gooey. Aside from the increased difficulty in handling the soggy sandwich, when one attempts to eat a soggy sandwich, the soggy bread often sticks to the roof of the eater's mouth and the overall sandwich eating experience is less enjoyable.

It is common for an assembled sandwich to sit in a storage container such as a school lunch box or a picnic basket for several hours before it is eaten. When stored fully assembled, it becomes a race against the clock if the eater wants to avoid the soggy sandwich.

In light of the above, it would be beneficial to provide a multi-compartmented storage device for storing the ingredients of a sandwich in separate compartments to prevent the wet ingredients from rendering the dry ingredients soggy so that the eater can enjoy a fresh, non-soggy sandwich several hours after leaving the kitchen.

SUMMARY OF THE INVENTION

The present invention is directed to a multi-compartmented food storage device. One embodiment of the present invention can include a generally cube shaped top storage compartment with a hinged lid, a generally cube shaped bottom storage compartment with a hinged lid, and an elongated central compartment that is hingedly secured to each of the top and bottom storage compartments.

Another embodiment of the invention can include a one-way valve in the storage compartments for removing any air that may be present in the storage compartment.

Alternative embodiments of the invention can include differently sized, shaped, and colored storage compartments to accommodate differently sized bread types as well as alternative embodiments having more than two central storage compartments to accommodate additional ingredients for the eater's sandwich.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1:
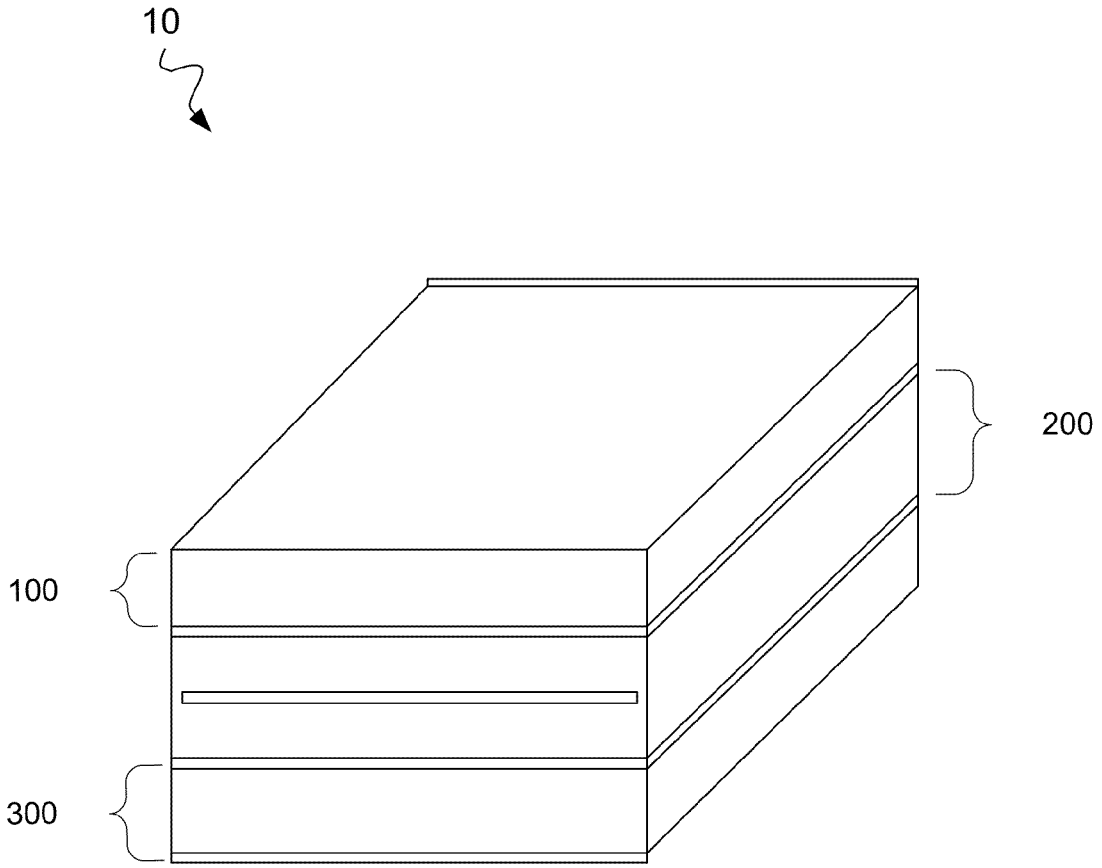
FIG. 1 is a perspective view of the sandwich storage device in its closed position, in accordance with one embodiment.

For purposes of this description, the terms "upper," "bottom," "right," "left," "front," "vertical," "horizontal," and derivatives thereof shall relate to the invention as oriented in FIG. 1. Additionally, although described throughout this document as pertaining to a sandwich, the invention is not to be construed as limiting in any way, as any number of food items can also be utilized herein.

FIG. 1 illustrates one embodiment of a multi-compartmented, hermetically sealed, food storage device 10 in a closed position that is useful for understanding the inventive concepts disclosed herein. As shown, the device 10 can include, essentially a top hermetic storage compartment 100 and a bottom hermetic storage compartment 300, that are hingedly secured to a central hermetic storage compartment 200. Although described and illustrated as including generally cube shaped compartments, this is for illustrative purposes only, as each compartment of the device can include any number of different shapes, sizes and dimensions, without limitation.

Figure 2:
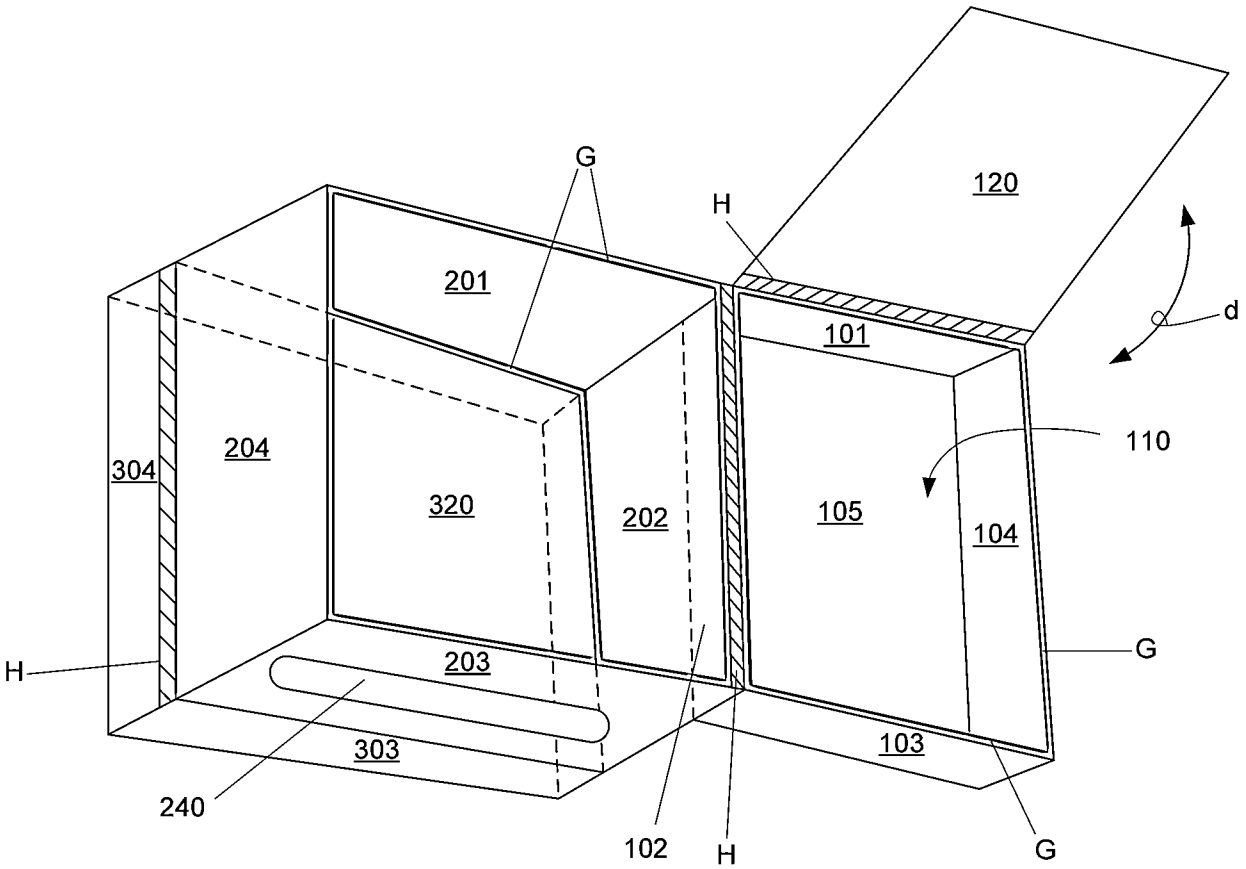
FIG. 2 is a perspective view of the top and central compartments of the sandwich storage device in a partially open position, in accordance with one embodiment.

FIG. 2 illustrates the device 10 in a partially open position, wherein the top and central storage compartments are accessible. As shown, the top hermetic storage compartment 100 can include plurality of generally vertical wall members 101-104 that are each in communication with a generally horizontal member 105 to form a generally cube shaped storage chamber 110. In the preferred embodiment, a gasket G can be formed along each of the wall members 101-104 and can function to engage the hinged H lid 120, to form an airtight hermetic seal when the compartment 100 is in the closed position.

The central hermetic storage compartment 200 can include a plurality of generally vertical wall members 201-204 forming an elongated, hollow and generally cube shaped storage chamber 250. The top hermetic storage compartment 100 is hingedly H secured to the vertical wall member 202 along the upper edge, and the bottom hermetic storage compartment 300 is hingedly H secured to the opposite vertical wall member 204 along the bottom edge. Such a feature allows each of the compartments 100 and 300 to independently move about the central compartment when transitioning between an open and closed position. Additionally, a pair of additional gaskets G is also positioned along the upper and lower edges of the wall members 201-204. Such a feature creates an airtight seal within the compartment 250 when the device is in the closed position.

Figure 2A:
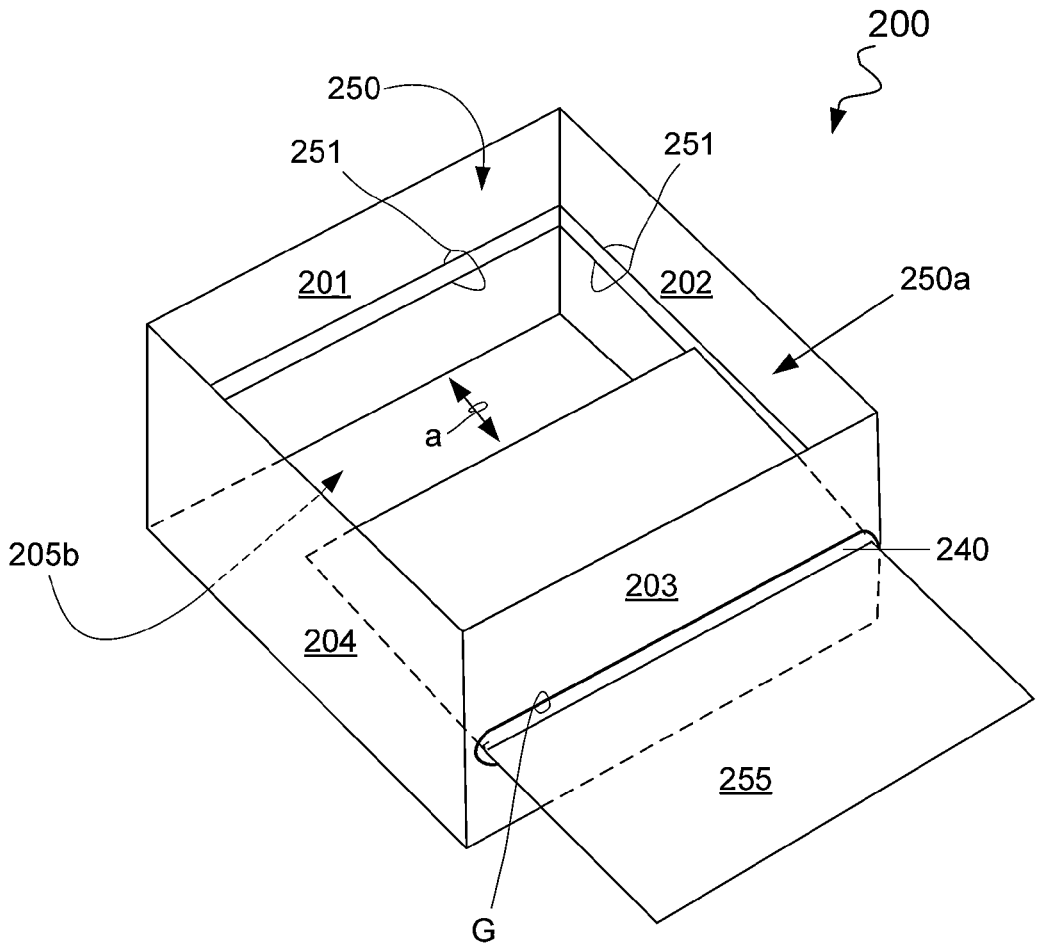
FIG. 2*a* is a partial cutout view of the central compartment of the device, in accordance with one embodiment.

As shown best in FIG. 2*a*, wherein compartments 100 and 300 are removed for ease of illustration, the vertical wall 203 can further include at least one horizontally disposed aperture 240 having a gasket G along the periphery thereof. The aperture 240 functioning to receive at least one flat separating member 255, which can slide within a centrally located channel 251 to removably engage (see arrow a) the horizontally disposed aperture 240 of the central storage compartment. As such, when the separating member 255 is fully positioned within the horizontally disposed aperture 240, the central storage chamber can be separated into two sub-compartments 250*a* and 250*b*.

Figure 3:
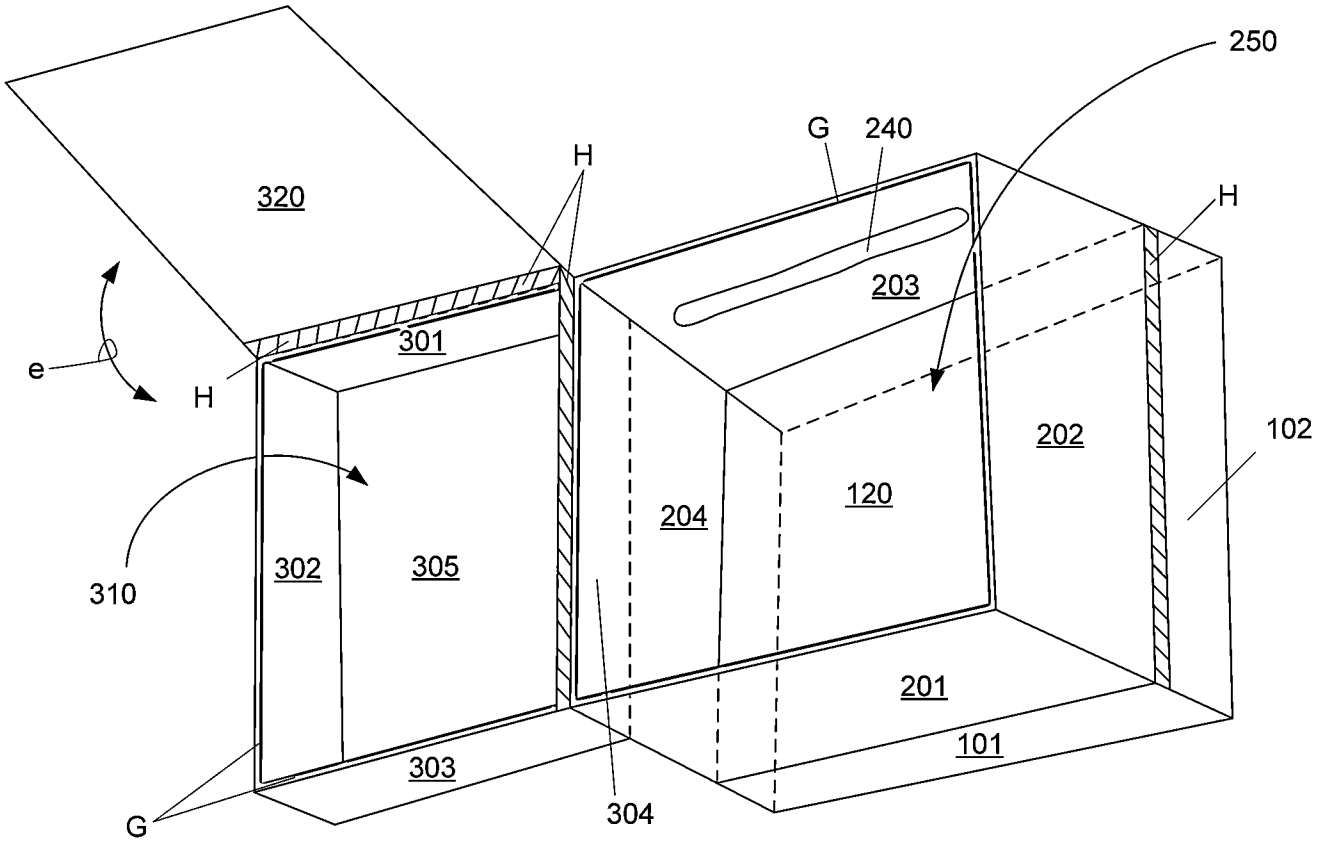
FIG. 3 is an inverted perspective view of the bottom and central compartments of the sandwich storage device in a partially open position, in accordance with one embodiment.

FIG. 3 illustrates the device 10 in an inverted and partially open position, wherein the bottom and central storage compartments are accessible. As shown, the bottom hermetic storage compartment 300 can include plurality of generally vertical wall members 301-304 that are each in communication with a generally horizontal member 305 to form a generally cube shaped storage chamber 310. A rubber gasket G or other known seal can be formed along each of the wall members 301-304 and can function to engage the hinged H lid 320, to form an airtight hermetic seal when the compartment 300 is in the closed position.

As described above, each of the gaskets G can preferably include a thin strip of rubber or rubber like material, which is permanently adhered to the device surfaces to create an airtight seal when the device is in the closed position. Of course, any number of other known malleable materials suitable for use in the food industry and capable of creating an air tight seal can also be utilized herein. Several examples include, foam, plastic and neoprene, for example.

In one preferred embodiment, the top hermetic storage compartment 100, the central hermetic storage compartment 200, and the bottom hermetic storage compartment 300 can be constructed from injection molded plastic, wherein the plurality of hinges H comprise living hinges which are formed at the time of manufacture. Of course, any number of other manufacturing materials and or manufacturing methods can be utilized including cardboard, rubber, metallic compounds and various combinations thereof, which are joined together by separated conventional hinge components.

Figure 4A:
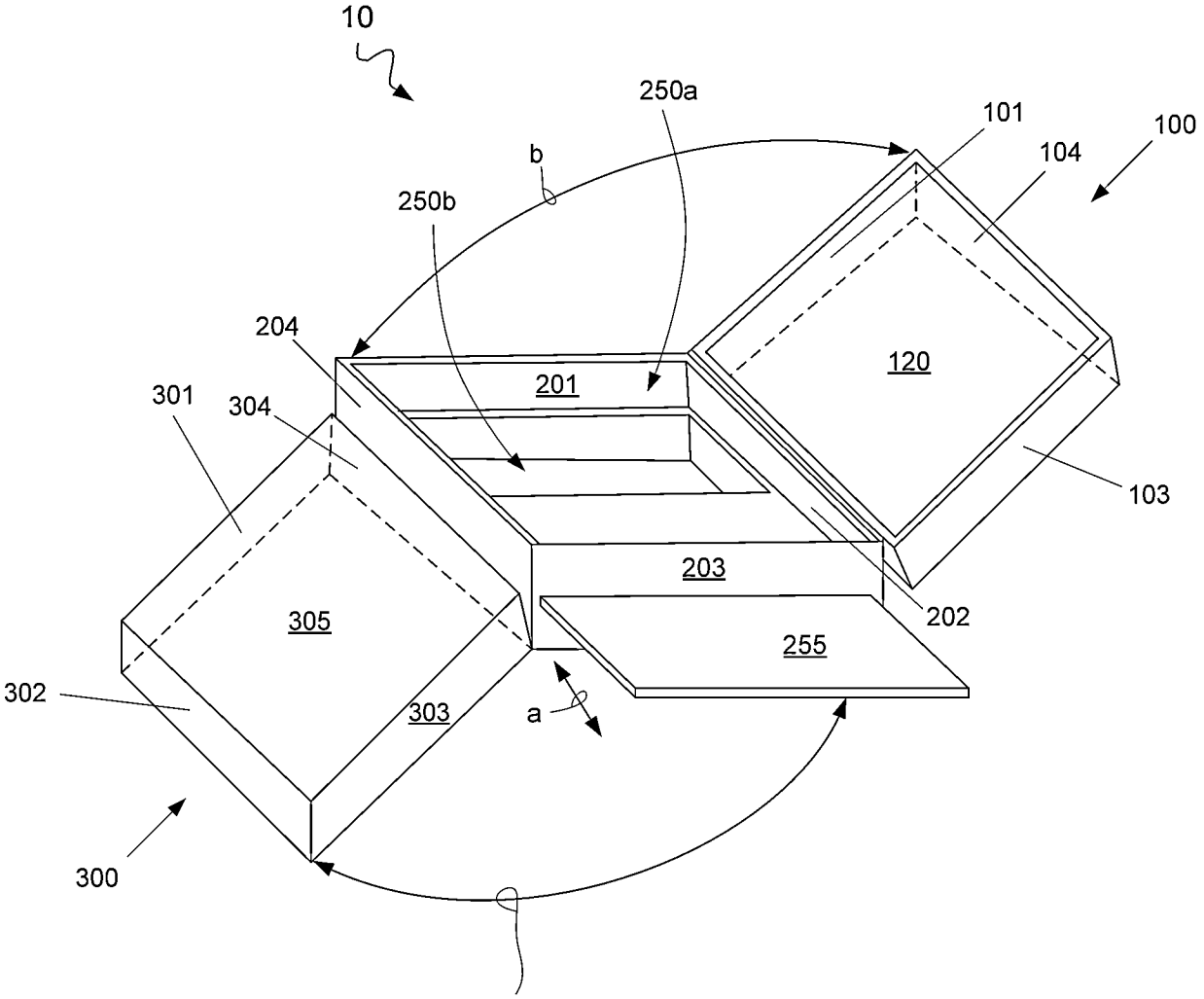
FIG. 4*a* is a perspective view of the sandwich storage device in a partially open position, in accordance with one embodiment.
Figure 4B:
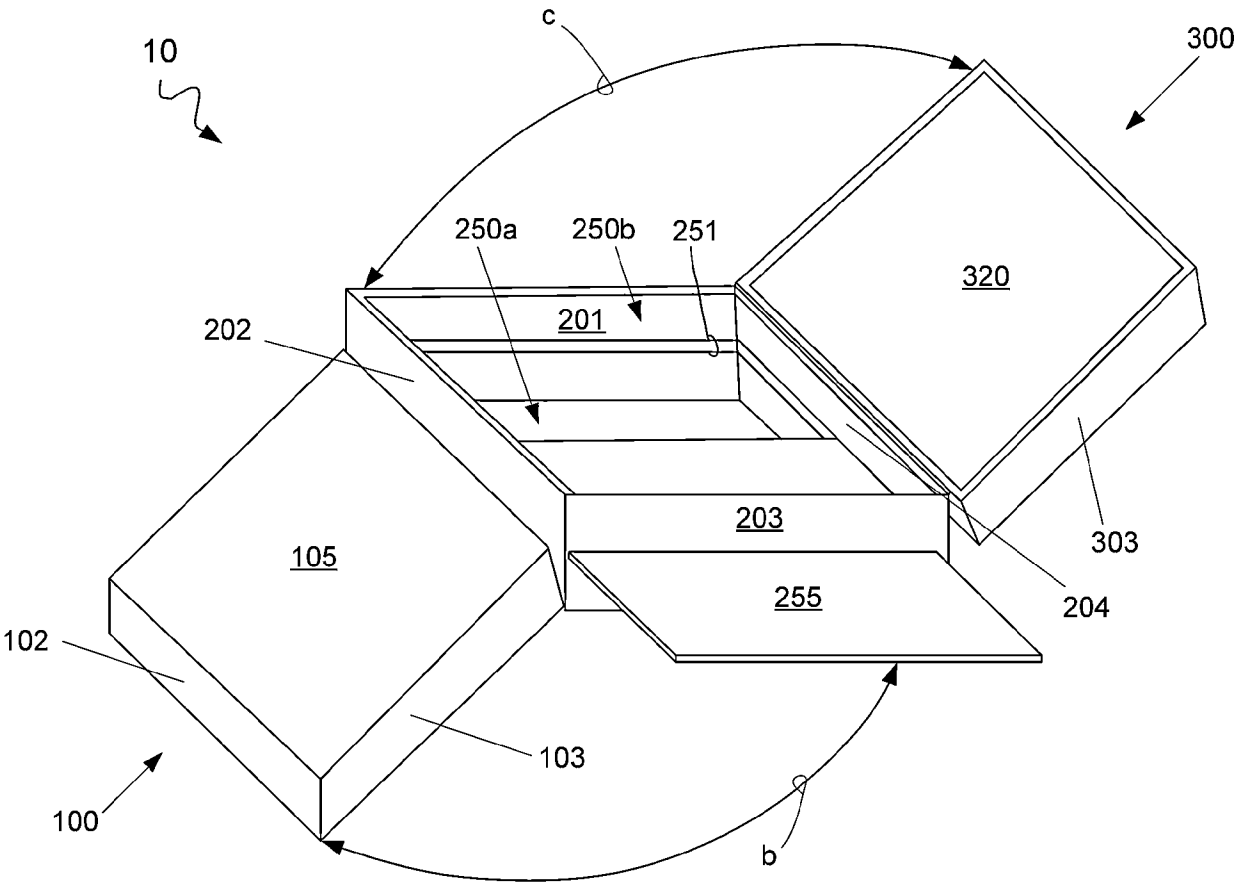
FIG. 4*b* is an inverted perspective view of the sandwich storage device in a partially open position, in accordance with one embodiment.

FIGS. 4*a* and 4*b* illustrate a top and bottom view of the device 10 in a partially open configuration. As shown by arrows b and c, each of the compartments 100 and 300 can fold across the hinges that are shared with the central compartment 200, to allow full access to the interior portion of compartment 200. When so positioned, each of the top compartment 100 and the bottom compartment 300 remain fully sealed.

Figure 5:
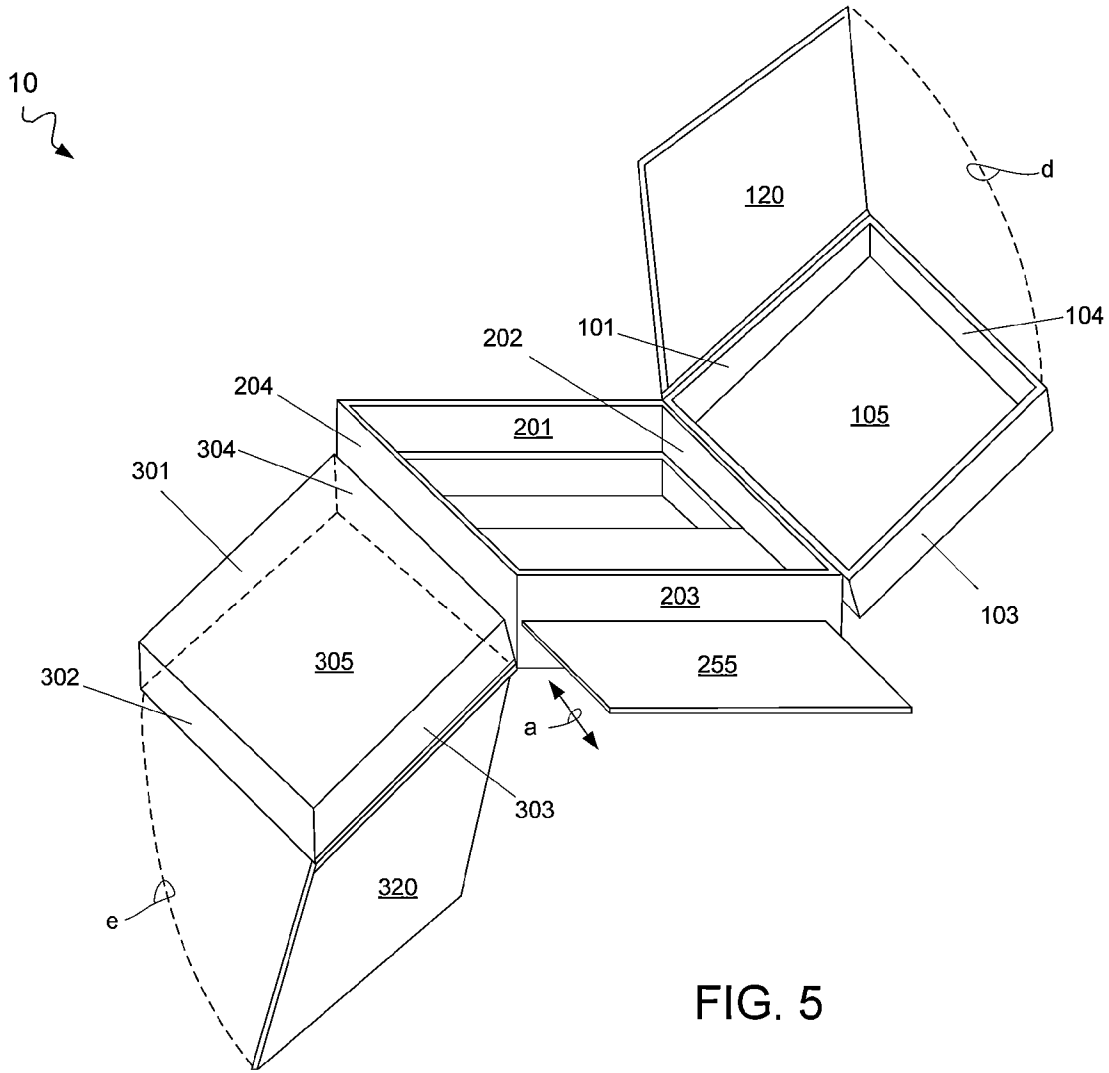
FIG. 5 is a perspective view of the sandwich storage device in a fully open position, in accordance with one embodiment.

FIG. 5 illustrates one embodiment of the device 10 in a fully open configuration. As shown by arrows d and e, the lids 120 and 320 of the compartments can fold to allow full access to the interior portion of compartments 200 and 300, respectively. As such, the device 10 can transition between the fully closed orientation described in FIG. 1, and the fully open configuration as shown.

While the dimensions of the hermetic storage compartments are not critical, in the preferred embodiment, each of the top and bottom storage compartments 100 and 300 can include a length (101-103 and 301-303) of approximately 8 inches, a width (102-104 and 302-304) of approximately 8 inches, and a depth (105-120 and 305-320) of approximately 2 inches. Additionally, the central compartment 200 can include a include a length (201-203) of approximately 8 inches, a width (202-204) of approximately 8 inches, and a depth (120-320) of approximately 4 inches. Such dimensions suitable for storing commercially available sandwich bread and other typical sandwich components. Of course, any number of other dimensions is also contemplated.

Figure 6:
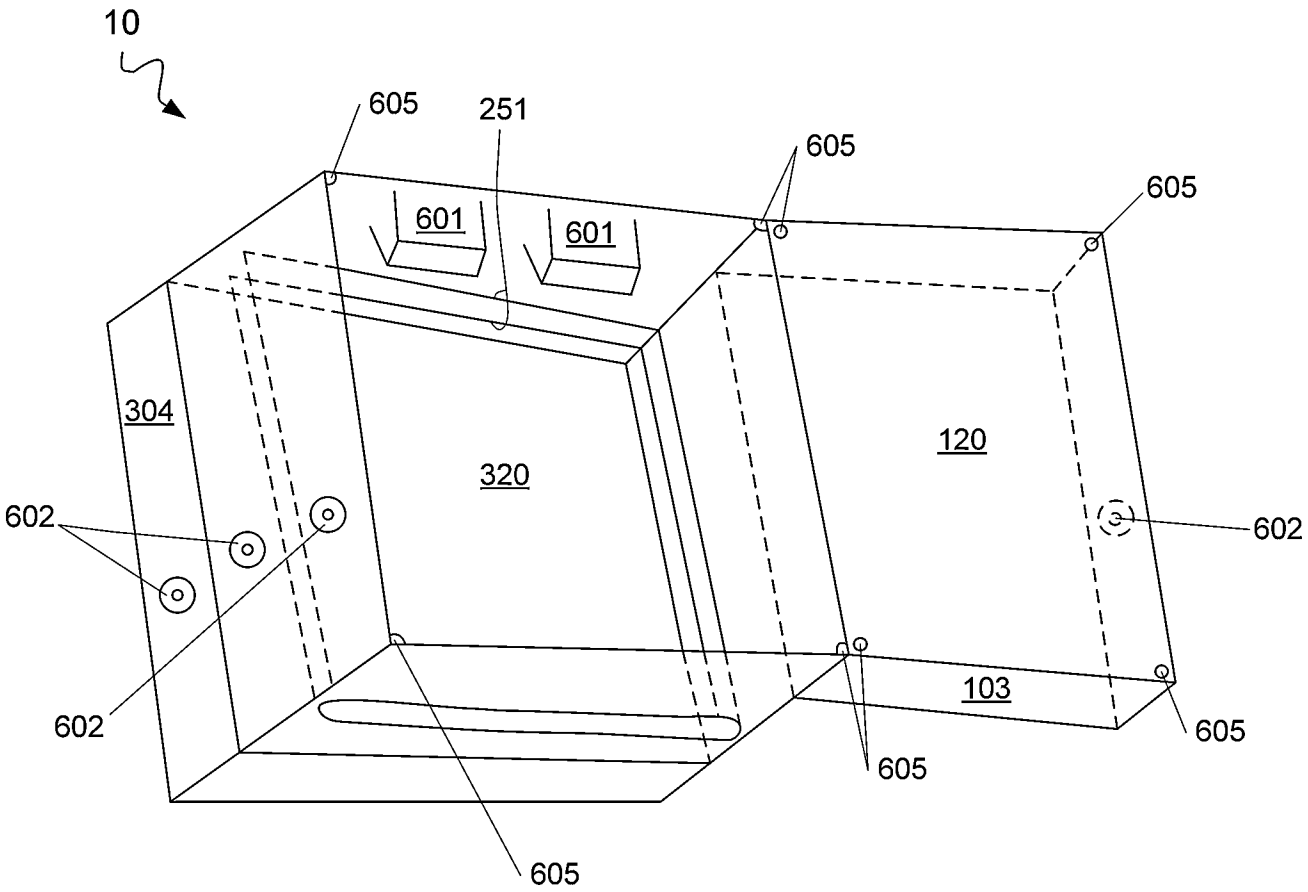
FIG. 6 is a perspective view of the sandwich storage device in a partially open position, in accordance with an alternate embodiment.

FIG. 6 illustrates an alternate embodiment of the device 10, that further includes a plurality of condiment holders 601 configured to receive and hold liquid condiments such as ketchup, mustard and mayonnaise, for example which can be applied to the sandwich at the time of eating. Additionally, the alternate embodiment can further include one or more one one-way air valves 602 which can be connected to one or more of the chambers 100, 200 and 300. The valves being sized and configured to engage an external vacuuming device (not pictured) to remove any air that might be present in the storage chambers of the device 10. As one way valves, their components, and the usage of the same are extremely well known in the art, no further description will be provided.

The device 10 can also include a plurality of connectors 605 that are disposed along the device edges to secure the top members 120 and 320 to their respective vertical members, and to secure the top and bottom compartments to the center compartment in order to lock the device into a closed position. As described herein, the connectors can include any number of known devices capable of securing two items together in a removable manner. Several examples include opposing strips of hook and loop material (i.e. Velcro®), magnetic elements disposed within the device materials, and compression fittings such as snaps, for example. Of course, the connector 505 can also be incorporated into the gasket G wherein the gasket can function to seal and lock the device, as described above. One commonly known example includes complementary male and female channels disposed along the periphery of each of the wall elements capable of locking together and creating an airtight seal. Such features can be incorporated into the present device in accordance with known construction methodologies.

In operation, a method of using the device 10 can begin in a fully open position, as illustrated in FIG. 5. To this end, a user can place a first piece of bread in the top storage compartment 100 and close the lid 120 (see arrow d), thereby hermetically sealing the bread within the storage chamber 110.

Next, the entire device 10 can be rotated 180 degrees so that the bottom storage compartment 300 is now facing upward (See FIG. 3). The user can then place a second piece of bread in the bottom storage compartment 300 and close the lid 320 (see arrow e), thereby hermetically sealing the second piece of bread within the bottom storage chamber 310.

At this time, the central storage compartment 200 is fully open, and each of the top and bottom storage compartments 100 and 300 are sealed, as shown in FIG. 4*b*. When so positioned, the separating member 255 can be fully positioned along the channel 251 (see arrow a), to separate the central compartment into the two sub-compartments 250*a* and 250*b*.

Next, the user can place sandwich components such as meat and cheese into sub compartment 250*b*, and rotate the bottom compartment 300 to a closed position (see arrow c), wherein the lid portion 320 of chamber 300 acts to hermetically seal compartment 250*b*.

Once again, the device is rotated by 180 degrees, so that a user can place any number of desired accouterments such as lettuce, tomato, etc. into the sub compartment 250*a*, and the the top compartment 100 can be rotated to a closed position (see arrow b), wherein the lid portion 120 of chamber 100 acts to hermetically seal compartment 250*a*.

At this point the device 10 is in its closed position as depicted in FIG. 1 and all of the ingredients of the sandwich are individually sealed in the four respective compartments 100, 300, 250*a* and 250*b*. Moreover, in certain embodiments of the invention having the one way valves 602, the vacuuming device can be engaged to remove any air in the compartments to allow for longer storage periods.

When the user wants to eat the sandwich, the user can simply rotate the top hermetic storage compartment 100 away from the central hermetic storage compartment 200 (see arrow b), and open the lid 120 (see arrow d), thereby exposing the first piece of bread that will serve as the top portion of the sandwich as well as the accouterments that are positioned within sub-compartment 250*a*.

Figure 7:
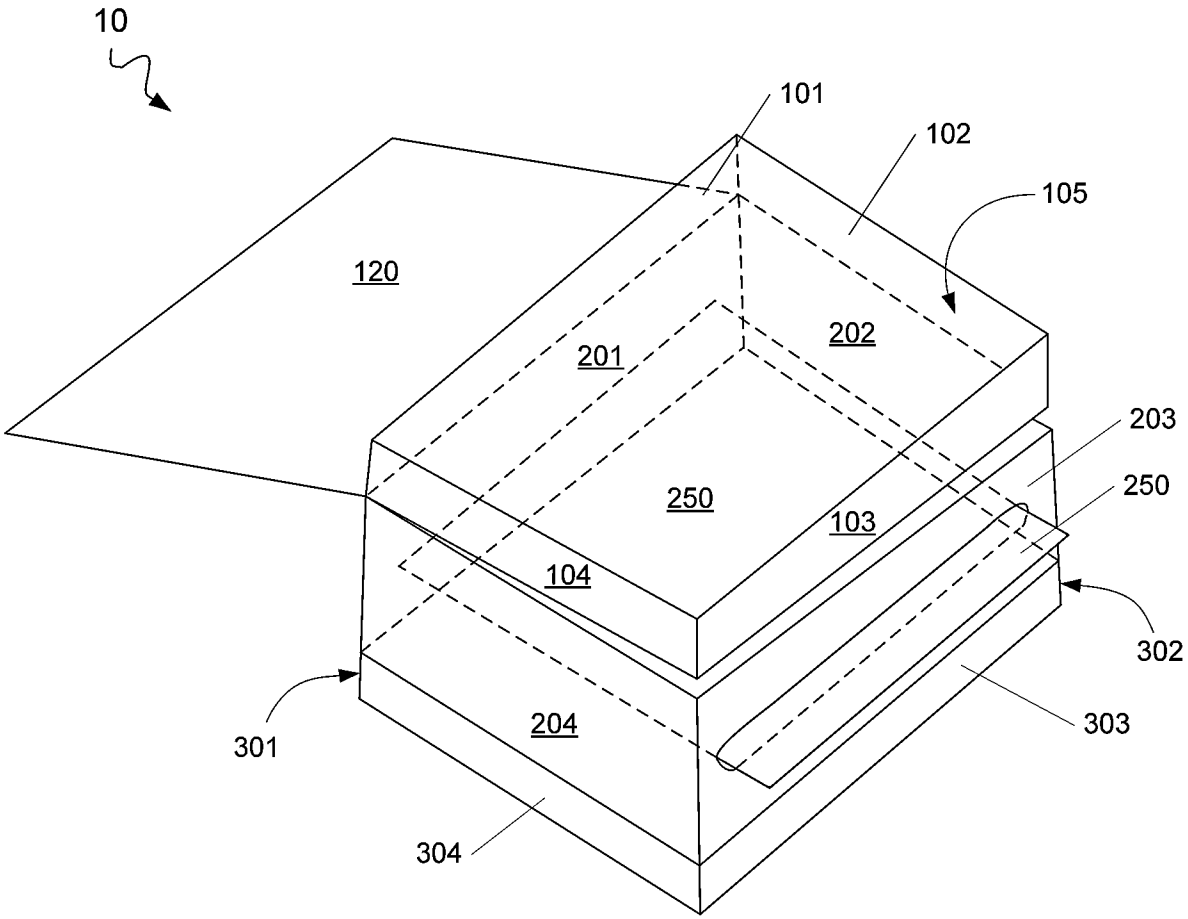
FIG. 7 is another perspective view of the device in a partially closed position in accordance with one embodiment of the invention.

As shown in FIG. 7, with the lid 120 in an open position, the top hermetic storage compartment 100 can be rotated back to the closed position (see arrow b) with respect to the central hermetic storage compartment 200 and by doing so, the bread that was housed in the top hermetic storage compartment 100 will fall and land squarely on top of the accouterments within sub-compartment 250*a*.

Next, the entire device 10 can be rotated 180 degrees so that the bottom hermetic storage compartment 300 is now facing upward. At this time, the bottom hermetic storage compartment 300 can be rotated away from the central hermetic storage compartment 200 (see arrow c), the lid 320 can be opened (see arrow e), thereby exposing the second piece of bread that will serve as the bottom portion of the sandwich as well as the meat that is positioned within sub-compartment 250*b*. With the lid 320 in an open position, the bottom hermetic storage compartment 300 can be rotated back to the closed position (see arrow c) with respect to the central hermetic storage compartment 200 and by doing so, the bread that was housed in the bottom hermetic storage compartment 100 will fall and land squarely on top of the meat within sub-compartment 250*b*.

At this time, the separating member 255 can be removed from the horizontally disposed aperture 240 to fully assemble the sandwich within the central compartment 200, and finally either the top hermetic storage compartment 100 or the bottom hermetic storage compartment 300 can be rotated away from the central hermetic storage compartment 200 to remove the assembled sandwich from the device and enjoy.

To this end, by providing a plurality of individually sealed compartments which can store and assemble sandwich ingredients, the device 10 functions to allow users to enjoy a fully assembled non soggy sandwich even though the ingredients may have been stored in the device 10 for several hours. In addition to providing a non-soggy sandwich, the device 10 also has practical applications in the healthcare arena, as the device 10 allows for a sandwich to be prepared in a sterile environment insomuch as the ingredients are never in contact with each other or the preparer until the sandwich is ready to be consumed. This may be of particular use to healthcare facilities that cater to patients with weakened immune systems.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A multi-compartmented sandwich storage device, said device comprising:

a top storage compartment having a plurality of side walls and a bottom wall that form a female storage chamber having an edge, and an air tight sealing member disposed thereon, said top storage compartment further including a male lid member that is removably engaged with the edge and the sealing member of the top female storage chamber so as to form a hermetically sealed compartment;

a bottom storage compartment having a plurality of side walls and a bottom wall that form a female storage chamber having an edge, and an air tight sealing member disposed thereon, said bottom storage compartment further including a male lid member that is removably engaged with the edge and the sealing member of the bottom female storage chamber so as to form a hermetically sealed compartment;

a central storage compartment having a top end that is hingedly secured to the top storage compartment at a first side, and a bottom end that is hingedly secured to the bottom storage compartment at a second side, said first and second sides being opposite to each other, wherein said central hermetic storage compartment comprises of a storage body having a top perimeter edge and a bottom perimeter edge, each of said edges including an air tight sealing member disposed thereon, said central storage compartment further including at least one horizontally disposed aperture with an air tight sealing member disposed about its perimeter; and at least one flat separating member having an air tight sealing member disposed about a perimeter thereof, said separating member being sized and configured to removably engage the horizontally disposed aperture of the storage body such that when the separating member is engaged with the horizontally disposed aperture of the storage body, the central storage compartment comprises two distinct sub-compartments and when the separating member is disengaged with the horizontally disposed aperture, the central storage compartment comprises a single hermetically sealed storage compartment.

2. The device of claim 1, wherein each of the sealing members are further configured to lock the compartments into a closed position.

3. The device of claim 1, further comprising:

a plurality of connectors disposed along each of the top compartment, the central compartment and the bottom compartment, said connectors functioning to secure each compartment in a closed position.

4. The device of claim 3, wherein the connectors include at least one of hook and loop material, and a compression fitting.

5. The device of claim 3, wherein the connectors include a plurality of magnetic elements.

6. The device of claim 1, further comprising:

at least one one-way air valve disposed about the device, sized and configured to engage a vacuuming device to remove air from the storage chambers of the device.

7. The device of claim 1, wherein the device is composed of injection molded plastic, and each hinge is a living hinge.

8. The device of claim 1, further comprising:

a plurality of condiment holders disposed within at least one of the device compartments.

9. A multi-compartmented sandwich storage device, comprising:

a top hermetic storage compartment, wherein said top hermetic storage compartment comprises of a female storage chamber with an edge, and a rubber gasket member disposed about said edge, and a removably attachable male lid member sized and configured to engage the edge of the female storage chamber such that the top storage compartment is hermetically sealed when the male lid member is engaged with the edge of the female storage chamber;

a central hermetic storage compartment, having a top end and a bottom end, hingedly attached to the top hermetic storage compartment, wherein said central hermetic storage compartment comprises of a storage body having a top perimeter edge and a bottom perimeter edge, with a rubber gasket disposed along said top perimeter edge and said bottom perimeter edge, wherein said storage body defines least one horizontally disposed aperture with a rubber gasket disposed about its perimeter; and at least one flat separating member, having a perimeter edge, with a rubber gasket disposed about said perimeter edge, wherein said separating member is sized and configured to removably engage the horizontally disposed aperture of the storage body sized and configured such that when the separating member is engaged with the horizontally disposed aperture of the storage body, the central storage compartment comprises two distinct sub-compartments and when the separating member is disengaged with the horizontally disposed aperture, the central storage compartment comprises of a single storage compartment; and a bottom hermetic storage compartment hingedly attached to the bottom end of the central hermetic storage compartment, wherein said bottom hermetic storage compartment comprises of a female storage chamber with an edge and a removably attachable male lid member sized and configured to engage the edge of the female storage chamber such that the bottom storage compartment is hermetically sealed when the male lid member is engaged with the edge of the female storage chamber.

10. A method of storing a sandwich in a sandwich storage device, said method comprising:

providing a multi-compartmented sandwich storage device that includes a top storage compartment having a plurality of side walls, a bottom wall and a lid that is hingedly secured to at least one of the side walls, a bottom storage compartment having a plurality of side walls, a bottom wall and a lid that is hingedly secured to at least one of the side walls, a generally hollow central compartment having a plurality of side walls and an elongated aperture, said central compartment being hingedly secured to the top storage compartment at a first end, and hingedly secured to the bottom storage compartment at a second end, and at least one flat separating member disposed within the aperture, wherein the top and bottom storage compartments are secured to the central compartment in a generally inverse relation to each other;

placing a first piece of bread in the top storage compartment;

closing the lid of the top storage compartment and sealing the bread therein;

placing sandwich meat in the central storage compartment;

engaging the separating member with the horizontally disposed aperture of the storage body;

placing accouterments onto the separating member;

rotating the top storage compartment into a secured position thereby engaging the central storage compartment;

rotating the entire device 180 degrees;

placing a second piece of bread in the bottom storage compartment;

closing the lid of the bottom storage compartment and sealing the second piece of bread therein; and rotating the bottom storage compartment into a secured position thereby engaging the central storage compartment.

* * * * *